United States Patent [19]

Town

[11] Patent Number: 4,679,257

[45] Date of Patent: Jul. 14, 1987

[54] WATERPROOF GLOVE

[76] Inventor: Allen W. Town, 415 W. John St., Alexandria, Ind. 46001

[21] Appl. No.: 877,459

[22] Filed: Jun. 23, 1986

[51] Int. Cl.[4] ..... A41D 19/00

[52] U.S. Cl. ..... 2/164; 2/159

[58] Field of Search ..... 2/158, 159, 160, 163, 2/164, 169, 272, 20, 21, 16

[56] References Cited

U.S. PATENT DOCUMENTS

| | | | |
|---|---|---|---|
| 2,210,754 | 8/1940 | Frank | 2/158 X |
| 2,538,837 | 1/1951 | Johnston | 2/169 |
| 2,840,823 | 7/1958 | Kita | 2/158 |
| 2,900,642 | 8/1959 | Bauer | 2/158 |
| 3,098,237 | 7/1963 | Slimovitz | 2/164 |
| 3,114,915 | 12/1963 | Gross | 2/164 X |
| 4,197,592 | 4/1980 | Klein | 2/164 X |
| 4,355,424 | 10/1982 | McCoy, Jr. | 2/164 X |
| 4,430,759 | 2/1984 | Jackrel | 2/164 X |
| 4,545,841 | 10/1985 | Jackrel | 2/164 X |
| 4,582,248 | 4/1986 | Edwards | 2/164 |

*Primary Examiner*—William Price
*Assistant Examiner*—T. Graveline
*Attorney, Agent, or Firm*—Woodward, Weikart, Emhardt & Naughton

[57] ABSTRACT

A glove or a mitten having a water proof membrane mounted therein. A membrane includes a plurality of outwardly extending tabs sealingly mounted thereto. The outer end of the membranes are secured to an outer shell which conformingly fits around the membrane. An inner liner is fixedly secured to the inwardly projecting ends of the tabs with the inner lining fitting within the water tight membrane. The outer shell, intermediate membrane and inner liner are all configured as a glove or a mitten being closed on all sides except one to allow the extension of a hand into the inner liner. Withdrawal forces applied by the hand against the inner liner are transferred through the tabs directly to the outer shell isolating the membrane from withdrawal forces.

25 Claims, 4 Drawing Figures

WATERPROOF GLOVE

BACKGROUND OF THE INVENTION

This invention is in the field of gloves and mittens and other similar articles of clothing having a waterproof, breathability or liquid penetration resistance requirement. Various specifications for industrial gloves, sporting gloves, consumer gloves, etc. exist which require gloves to have a waterproof, breathability or a liquid penetration resistance characteristic. Where these characteristics are achieved with a waterproof membrane the gloves have been found to be less than adequate primarily in the durability of attachment. The prior gloves typically include a water resistant membrane mounted between an inner liner and the outer shell of the glove. The mounting is accomplished by means such as stitching and/or with use of adhesives with the water resistant membrane mounted directly to the inner liner and/or outer shell. In the event the stitching extends through the water resistant membrane, then the water barrier is broken. Further, as the hand is removed from the glove, withdrawal forces are applied by the hand to the inner liner and in turn the withdrawal force is applied directly to the water resistant membrane. Such membranes are typically produced from thin plastic materials and will easily tear as withdrawal forces are applied thereto destroying the water resistant feature.

The linings of the prior gloves often pull out from the fingers of the glove when the hand is removed from the glove. Reinsertion of the liners into the fingers is next to impossible without considerable effort and time being expended. Disclosed herein is a new glove fabrication and a method of fabricating a covering for a hand which prevents the liners and membranes from pulling out of the fingers of the glove and which also directs the hand withdrawal forces exerted on the inner liner directly into the outer shell thereby isolating the water resistant membrane from any pulling or tearing force.

SUMMARY OF THE INVENTION

One embodiment of the present invention is a covering for the hand comprising an outer shell closed on all sides except one which has an opening through which the hand may extend into the shell, a membrane of material and being positioned within the outer shell and closed on all sides except one which is opened and aligned with the opening to allow the hand to extend into the membrane, and, attachment means sealingly secured to the membrane and extending outwardly therefrom to the outer shell whereat it is attached being operable to attach the membrane to the outer shell.

Another embodiment of the present invention is a method of constructing a covering for a hand comprising the steps of producing an outer shell with an opening for the hand to extend into the shell, producing an intermediate lining to fit within the shell and also having an opening for the hand to extend into the intermediate lining, producing an inner liner to fit within the intermediate lining and also having an opening for the hand to extend into the inner liner, extending a tab through the intermediate lining so the tab extends into the intermediate lining and also outwardly therefrom, and, attaching the tab to the outer shell and to the inner liner to transfer any withdrawal force exerted against the inner liner by the hand as it is withdrawn therefrom to the outer shell isolating the intermediate lining from the force.

Yet a further embodiment of the present invention is a water resistant glove comprising a main glove body including a plurality of fingers, a water resistant membrane positioned within the main glove body and extending into the fingers, an inner liner positioned within the membrane and extending into the fingers, and, attachment means extending through the membrane and having members located in the fingers with each of the members having an inner end located within the membrane and also having an outer end projecting therefrom with the inner end attached to the inner liner and the outer end attached to the main glove body transferring any withdrawal force exerted by a withdrawing hand against the inner liner directly to the main glove body isolating the membrane from the force.

It is an object of the present invention to provide a new and improved covering for the hand.

Yet another object of the present invention is to provide a new and improved article of clothing.

In addition, it is an object of the present invention to provide a waterproof glove having a water resistant interior barrier which is isolated from any hand withdrawal forces exerted on the glove.

Related objects and advantages of the present invention will be apparent from the following description.

DESCRIPTION OF THE PREFERRED EMBODIMENT

Figure 1:
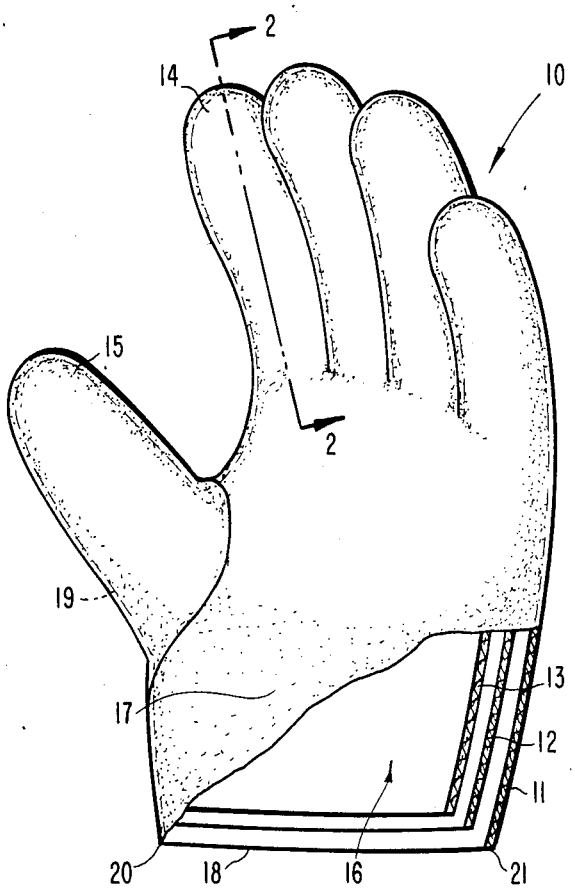
FIG. 1 is a fragmentary view of a glove incorporating the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a glove 10 incorporating the present invention. Glove 10 includes an outer main glove body or shell 11 having mounted therein an intermediate lining 12 which is a waterproof membrane of a material having a moisture impervious property. Mounted within membrane 12 is an inner liner 13 which is contact with the skin of the hand. Shell 11, membrane 12 and inner liner 13 are each configured or shaped in a conventional glove or hand shape having four fingers 14 along with a thumb 15. Shell 11, membrane 12 and inner liner 13 are closed on all sides except one side which has an opening 16 through which the hand may extend into the glove.

Figure 2:
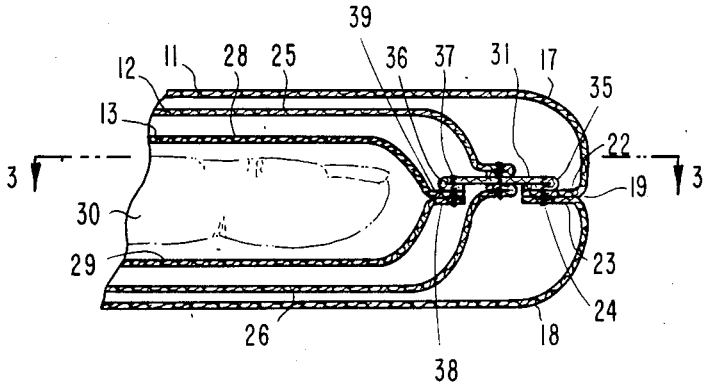
FIG. 2 is an enlarged fragmentary cross-sectional view taken along line 2—2 of FIG. 1 and viewed in the direction of the arrows.
Figure 3:
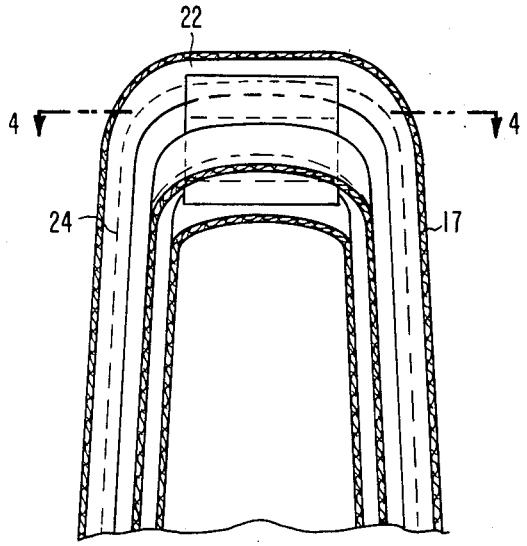
FIG. 3 is a fragmentary cross-sectional view taken along the line 3—3 of FIG. 2 and viewed in the direction of the arrows.

Outer shell 11 consists of a palm side portion 17 sewn along its peripheral edge to the peripheral edge of the backside portion 18. Portion 18 is secured to portion 17 along seam 19 which extends from one side 20 of opening 16 along the periphery of the glove around the thumb and fingers to the opposite side 21 of opening 16. Seam 19 (FIG. 2) is formed by securing the edge portions together by conventional means such as stitching 24 and then turning inwardly the mutually facing edge portions 22 and 23 of portions 17 and 18. An alternate embodiment includes forming seam 19 by securing the mutually facing edge portions 22 and 23 of portions 17 and 18 together and leaving the edge portions 22 and 23 projecting outwardly.

The waterproof or water resistant membrane 12 likewise has a palm side portion 26 and a second portion 25 secured together along a seam which extends around the periphery of membrane 12 from location 20 to location 21 except at opening 16 whereat the portions are spaced apart to allow extension of the hand into the glove. Membrane 12 extends into the thumb and four fingers of the outer shell of the glove. The membrane may be produced from any type of waterproof or water resistant/breathable material such as plastic sheet or laminate of plastic and fabric or any other suitable material. In such a case, the peripheral edge portion of portions 25 and 26 are secured together by any type of conventional welding such as ultrasonic, dielectric, radio frequency, heat sealing or other means which provide for waterproof construction.

The inner liner 13 is for the purpose of thermal insulation and/or comfort or protection and likewise consists of a palm side portion 29 and an opposite portion 28 being joined together along their mutually facing and adjacent edge portions extending from location 20 through thumb 15 and fingers 14 to location 21 with portions 28 and 29 being separated apart at opening 16 to facilitate extension of the hand into the glove. Shell 11 and inner liner 13 may be produced from fabric or other suitable materials. Portions 28 and 29 may be secured together by stitching as is the case for portions 17 and 18.

Retraction of fingers 30 (FIG. 2) along with the remaining portion of the hand in the prior art gloves causes withdrawal forces to be applied to the inner liner 13 thereby normally pulling the inner liner and intermediate liner out of the fingers of the outer shell. In addition, in the event the plastic membrane or intermediate lining 12 is sewn or attached directly to either the outer shell or inner liner, pulling or tearing forces will be applied to the membrane providing for rupture or destruction of the membrane allowing water or moisture to seep into the inner liner. I have therefore provided an attachment means 31 within each finger and thumb for attaching the outer shell, intermediate liner or membrane along with the inner liner together in such a manner to apply the withdrawal forces exerted on the inner liner directly to the outer shell isolating the membrane from any pulling or tearing force. The attachment means is also operable to prevent removal of the inner liner and intermediate lining from the fingers of the shell.

Figure 4:
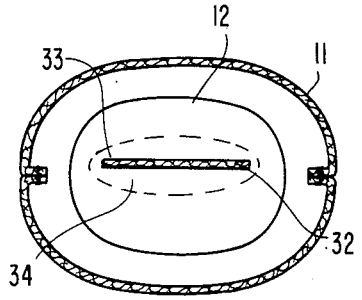
FIG. 4 is a cross-sectional view taken along the line 4—4 of FIG. 3 and viewed in the direction of the arrows.

The attachment means 31 includes a plurality of tabs 32 (FIG. 4) which extend through slots or openings 33 formed in each tip portion 34 of the thumb and finger portions of membrane 12 and extending into the thumb and finger portions of outer shell 11. The construction of the glove finger surrounding the index finger 30 and the attachment means will be described, it now being understood that a similar description applies to the attachment means located in the remaining three glove fingers and thumb.

Tab 32 may be produced from a sheet of plastic or any material that has sufficient strength to secure the components together and includes an outer end 35 (FIG. 2) which is secured by stitching 24 to the inwardly turned adjacent edge portion 22 and 23 of the portions 17 and 18 of the outer shell in the case of inseam construction or to the outwardly extending adjacent edge portion 22 and 23 in the case of outseam construction which is not shown in the drawings but which is contemplated and included in the present invention. Tab 32 then extends sealingly through intermediate lining 12 and has an inner end 36 secured by stitching 37 to the mutually facing and adjacent outwardly extending edge portions 38 and 39 of portions 28 and 29 of the inner liner 13. Likewise, in the event that an inseam construction is used for the inner liner 13, then the tab 32 is attached to the inwardly extending adjacent edge portions of the inner liner. Prior to attaching tab 32 to the inner liner 13, the edge portions 38 and 39 are sewn together along the entire periphery of inner liner 13 from location 20 to location 21 except at opening 16 where portions 28 and 29 are spaced apart allowing the hand to extend therethrough. Thus, as the finger 30 is withdrawn from the glove, withdrawal forces may be applied to inner lining 13 by the finger with the withdrawal forces then being applied through member 32 directly to the outer shell 11. Since the intermediate lining or membrane 12 floats or is loose within the glove except at the point of attachment to members 32 within the distal end portions of the thumb and fingers, the withdrawal forces will not be applied to intermediate lining 12 thereby preventing tearing of the relatively thin lining 12. Both outer end 35 and inner end 36 of tab 32 are looped back upon the main body of the tab providing a double thickness at each end.

The method of constructing the glove or covering for the hand shown in the drawing includes the steps of producing outer shell 11, intermediate lining 12 and inner liner 13 each with an opening for the hand to extend therein and with the inner liner fitted within the intermediate lining which in turn is fitted within the outer shell. The intermediate lining is produced from a membrane of moisture impervious material such as plastic. It may include in one embodiment the substeps of positioning a first piece of plastic, that is, portion 26 having an edge portion with the tab 32 then being placed upon the first piece of plastic to extend outwardly of the edge. A second piece of plastic 25 having an edge portion is then placed upon the first piece of plastic so that the tab is located therebetween. In other words, portions 25 and 26 are located so their edge portions are aligned and adjacent with tab 32 extending outwardly thereof. The entire intermediate lining or membrane is then sealed so the edge portions or the two portions are sealed together while at the same time the tabs are sealed to each portion insuring the seal surrounding each tab is continuous with the seal of each edge portion providing a continuous water tight joint along the entire periphery of the membrane except at opening 16. The sealing step may include heat sealing or other types of conventional sealing methods for plastic. The sealing of the tab to the membrane 12 is accomplished in such a manner to insure that the tab is integrally connected to the membrane insuring a water tight seal therebetween. In the event that the intermediate lining is to have an inseam construction then the end of each tab extending outwardly from the intermediate lining is attached or sewn to the outwardly extending edge portions 38 and 39 of the distal end portion for each finger and thumb of the inner liner 13 and the intermediate lining or membrane is turned inside out to surround the inner liner 13. As such, the outer end of the tab sewn to the inner liner then becomes the inwardly located end of the tab with the opposite end of the tab then extending outwardly of the membrane for subsequent attachment by sewing to the portions 22 and 23 of the outer shell. In the event that the outer shell has an inseam construction, then portions 22 and 23 are generally sewn together and the outward end of the tab is then sewn to the seam existing between portions 22 and 23 with the outer shell then being turned inside out enclosing the intermediate lining. In the event that the outer shell has an outseam construction, then portions 22 and 23 along with the outward end of the tab is simultaneously sewn together.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A covering for the hand comprising:

an outer shell closed on all sides except one which has an opening through which the hand may extend into said shell;

a membrane of material and being positioned within said outer shell and closed on all sides except one which is opened and aligned with said opening to allow the hand to extend into said membrane; and, attachment means including an attachment tab sealingly secured to said membrane and extending outwardly therefrom to said outer shell whereat it is attached being operable to attach said membrane to said outer shell.

2. The covering of claim 1 wherein said covering is waterproof and said membrane is waterproof and of a material having a moisture impervious property and said attachment means is operable to attach said membrane to said outer shell while allowing said waterproof membrane to maintain its moisture impervious property and further comprising:

an inner lining positioned within said waterproof membrane and extending around said hand; and wherein:

said attachment means includes an attachment tab extending through said waterproof membrane and inwardly therefrom to said inner lining whereat it is attached to said inner lining transferring any withdrawal force exerted against said inner lining by said hand as it is withdrawn directly to said outer shell isolating said waterproof membrane from said force.

3. The waterproof covering of claim 2 wherein:

said attachment means includes at least one attachment tab with an outer end and an opposite inner end, said outer end is attached to said outer shell and said inner end is attached to said inner lining.

4. The waterproof covering of claim 3 wherein:

said membrane includes a slot through which said attachment tab extends with said membrane sealingly joined to said attachment tab entirely around said attachment tab at said slot.

5. The waterproof covering of claim 4 wherein:

said membrane and said attachment tab are both plastic and are integrally sealed together.

6. The waterproof covering of claim 5 wherein:

said outer end is sewn to said outer shell and said inner end is sewn to said inner lining.

7. The waterproof covering of claim 6 wherein:

said outer shell, said waterproof membrane and said inner lining are each glove configured with a plurality of finger formations each with a tip portion with said attachment means including a separate attachment tab within each of said finger formations, each attachment tab including an outer end and an opposite inner end, said outer end is attached to said outer shell and said inner end is attached to said inner lining.

8. The waterproof covering of claim 7 wherein:

said outer shell includes a pair of hand configured sheets sewn together along a seam with said outer end of each attachment tab sewn into said seam only at said tip portion of each finger formation allowing said attachment tab to move relative to said outer shell except at said tip portion.

9. A method of constructing a covering for a hand comprising the steps of:

producing an outer shell with an opening for the hand to extend into said shell;

producing an intermediate lining to fit within said shell and also having an opening for the hand to extend into said intermediate lining;

producing an inner liner to fit within said intermediate lining and also having an opening for the hand to extend into said inner liner;

extending a tab through said intermediate lining so said tab extends into said intermediate lining and also outwardly therefrom; and, attaching said tab to said outer shell and to said inner liner to transfer any withdrawal force exerted against said inner liner by the hand as it is withdrawn therefrom to said outer shell isolating said intermediate lining from said force.

10. The method of claim 9 comprising the additional steps of:

producing said intermediate lining from a membrane of moisture impervious material; and, sealing said tab to said intermediate lining to limit movement of moisture therebetween.

11. The method of claim 10 wherein:

said sealing step includes integrally fastening said tab to said intermediate lining entirely around said tab at the location of its entry into said intermediate lining.

12. The method of claim 11 wherein:

said sealing step includes the step of heat sealing said tab to said intermediate lining and said attaching step includes the step of sewing said tab to said outer shell and said inner liner.

13. The method of claim 10 wherein:

said producing of an intermediate lining step includes the substeps of positioning a first piece of plastic having an edge portion, placing said tab upon said first piece of plastic, and positioning a second piece of plastic having an edge portion upon said first piece of plastic with said tab therebetween; and, said sealing step includes the step of sealing said edge portion of said first piece of plastic to said edge portion of said second piece of plastic while sealing said tab thereto so that the seal at said tab is continuous with the seal at each edge portion.

14. The method of claim 10 wherein:

said attaching step includes the steps of:

attaching said tab to said inner liner prior to attaching said tab to said outer shell.

15. A water resistant glove comprising:

a main glove body including a plurality of fingers;

a water resistant membrane positioned within said main glove body and extending into said fingers;

an inner liner positioned within said membrane and extending into said finger; and, attachment means including an attachment tab extending through and sealingly secured to said membrane in said fingers with said attachment tab having an inner end projecting inwardly from said membrane and also having an outer end projecting outwardly therefrom with said inner end attached to said inner liner and said outer end attached to said main glove body and transferring any withdrawal force exerted by a withdrawing hand against said inner liner directly to said main glove body isolating said membrane from said force.

16. The glove of claim 15 wherein:

said attachment means includes a plurality of attachment tabs, and said membrane includes slot through which said attachment tabs extend with said membrane sealingly joined to said tabs entirely around said slots.

17. The glove of claim 16 wherein:

said membrane and said attachment tabs are both plastic and are integrally sealed together.

18. The glove of claim 17 wherein:

said outer end is sewn to said main glove body and said inner end is sewn to said inner liner.

19. The glove of claim 18 wherein:

said main glove body, said membrane and said inner liner are each glove configured with a plurality of finger formations each with a tip portion with said attachment tabs located in said finger formations and attached only at said tip portion of each finger formation allowing said membrane to move relative to said main glove body except at said tip portion.

20. A waterproof covering for the hand, comprising:

an outer shell closed on all sides except one which has an opening through which the hand may extend into said shell;

a waterproof membrane of a material having a moisture impervious property and being positioned within said outer shell, enclosed on all sides except one which is open and aligned with said opening to allow the hand to extend into said membrane;

an inner lining positioned within said waterproof membrane and extending around said hand; and attachment means including an attachment tab with an outer end and an opposite inner end, said outer end attached to said outer shell and said inner end attached to said inner lining, and said attachment tab sealingly secured to and extending through said waterproof membrane, said attachment tab being operable to transfer any withdrawal force exerted against said inner lining by said hand as said hand is withdrawn directly to said outer shell isolating said waterproof membrane from said force and allowing said waterproof membrane to maintain its moisture impervious property.

21. The waterproof covering of claim 20 wherein:

said waterproof membrane includes a slot through which said attachment tab extends with said waterproof membrane sealingly joined to said attachment tab entirely around said attachment tab at said slot.

22. The waterproof covering of claim 21 wherein:

said waterproof membrane and said attachment tab are both plastic and are integrally sealed together.

23. The waterproof covering of claim 22 wherein:

said outer end is sewn to said outer shell and said inner end is sewn to said inner lining.

24. The waterproof covering of claim 23 wherein:

said outer shell, said waterproof membrane and said inner lining are each glove configured with a plurality of finger formations each with a tip portion with said attachment means including a separate attachment tab within each of said finger formations, each attachment tab including an outer end and an opposite inner end, said outer end is attached to said outer shell and said inner end is attached to said inner lining.

25. The waterproof covering of claim 24 wherein:

said outer shell includes a pair of hand configured sheets sewn together along a seam with said outer end of each attachment tab sewn into said seam only at said tip portion of each finger formation allowing said attachment tab to move relative to said outer shell except at said tip portion.

* * * * *